US008029061B2

(12) United States Patent
Fukai

(10) Patent No.: US 8,029,061 B2
(45) Date of Patent: Oct. 4, 2011

(54) LINK MECHANISM FOR A CHAIR AND A CHAIR

(75) Inventor: Zenroh Fukai, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 12/923,642

(22) Filed: Sep. 30, 2010

(65) Prior Publication Data

US 2011/0031794 A1 Feb. 10, 2011

Related U.S. Application Data

(62) Division of application No. 12/289,984, filed on Nov. 7, 2008.

(30) Foreign Application Priority Data

Oct. 7, 2008 (JP) ..... 2008-260244

(51) Int. Cl.
*A47C 1/032* (2006.01)

(52) U.S. Cl. ..... 297/320; 297/321

(58) Field of Classification Search ..... 297/320, 297/321

See application file for complete search history.

(56) References Cited

U.S. PATENT DOCUMENTS 4,411,469 A 10/1983 Drabert et al.
4,627,663 A * 12/1986 LaPointe ..... 297/321
4,761,033 A * 8/1988 Lanuzzi et al. ..... 297/320
4,988,145 A * 1/1991 Engel ..... 297/321 X
5,080,435 A * 1/1992 Desanta ..... 297/320

FOREIGN PATENT DOCUMENTS

| | | |
|---|---|---|
| JP | 1-16488 | 3/1989 |
| JP | 4037438 | 2/1992 |
| JP | 2000-505677 | 5/2000 |
| JP | 2001-29169 | 2/2001 |
| JP | 2007-152145 | 6/2007 |

OTHER PUBLICATIONS

Wilkhahn Website Online "Modus: Function" on the Internet <HTTP://WWW.WILKHAHN.CO.JP/PRODUCTS/WORKING/MODUS/FUNCTION.HTML> (Searched Jun. 15, 2006).

Office Action mailed on Dec. 21, 2010, issued by the United States Patent and Trademark Office in U.S. Appl. No. 12/289,984 (which is the parent of the above-identified application).

* cited by examiner

*Primary Examiner* — Anthony D Barfield
(74) *Attorney, Agent, or Firm* — Rabin & Berdo, PC

(57) ABSTRACT

There is provided a link mechanism for a chair that is a link mechanism that is used at a chair, the link mechanism for a chair having: a first link whose one end is connected to a bottom surface of a link that supports a seat surface portion of the chair; a second link whose one end is connected to another end of the first link; a first joint portion rotatably connecting the first link and the second link; a second joint portion provided at another end of the second link; and a first elastic resistance unit imparting elasticity in a rotating direction to the second joint portion.

12 Claims, 16 Drawing Sheets

LINK MECHANISM FOR A CHAIR AND A CHAIR

CROSS-REFERENCE TO RELATED APPLICATION

This is a Divisional of U.S. application Ser. No. 12/289,984, filed Nov. 7, 2008, which claims priority of Japanese Patent Application No. 2008-260244, pursuant to the provisions of 35 U.S.C. §119, the subject matters of which are incorporated herein by reference.

BACKGROUND OF THE INVENTION

1. Field of the Invention

The present invention relates to a link mechanism for a chair that is used in a chair, and relates to a chair.

2. Description of the Related Art

As chairs that are used in offices and the like, there have conventionally been proposed chairs in which, when a user rests against the backrest, i.e., the back surface portion, the seat surface portion operates interlockingly with the back surface portion (see, for example, Japanese Patent Application National Publication No. 2000-505677, Japanese Patent No. 4037438, and the "Modus:Function" section of the homepage of Wilkhahn at http://www.wilkhahn.co.jp/products/working/modus/function.html).

FIG. 14 is a drawing showing the structure of a conventional chair.

In FIG. 14, 113 is a base portion of a conventional chair. The base portion has supports, casters, and the like that are not illustrated, and is placed on a floor surface, and supports the mass of the entire chair and a user seated on the chair.

A seat surface portion 114, on which a user sits, is rotatably mounted to the upper end of the base portion 113 via a joint portion. Further, a first link 112 that supports a back surface portion 115 is rotatably mounted via a joint portion to an intermediate portion of the base portion 113.

The seat surface portion 114 and the first link 112 are connected by a second link 111 that is rotatably mounted to the both via joint portions.

When a user who is seated on the seat rests against the back surface portion 115, the first link 112 that supports the back surface portion 115 rotates around the joint portion with respect to the base portion 113. Further, because the seat surface portion 114 is connected to the first link 112 by the second link 111, interlockingly with the first link 112, the seat surface portion 114 rotates around the joint portion with respect to the base portion 113.

However, in the above-described conventional chair, the seat surface portion 114 does not operate unless force is applied to the back surface portion 115, and therefore, the user cannot always assume an optimal seated posture.

Namely, the seat surface portion 114 does not operate if the user who is seated on the seat surface portion 114 does not tilt his/her back more than the angle of inclination of the back surface portion 115 with respect to the seat surface portion 114 in the initial state.

Accordingly, in a case in which the user who is seated on the seat surface portion 114 does not rest against the back surface portion 115, such as, for example, a case in which the user is working while facing his/her desk, the angle of the seat surface portion 114 does not change. Therefore, the user cannot always assume an optimal seated posture.

For example, when the user is seated with a forward-leaning posture so as to face a desk, the user is not resting against the back surface portion 115, and thus, the back surface portion 115 does not fit the lumbar region, and the posture of the person who is seated deteriorates.

Thus, a construction that is such that the user of a chair can always assume an optimal seated posture is desired.

SUMMARY OF THE INVENTION

In view of the aforementioned, the present invention provides a link mechanism for a chair that is used in a chair, and a chair.

In accordance with a first aspect of the present invention, there is provided a link mechanism for a chair that is used at a chair, the link mechanism comprising: a first link having one end connected to a bottom surface of a link that supports a seat surface portion of the chair; a second link having one end connected to another end of the first link; a first joint portion rotatably connecting the first link and the second link; a second joint portion provided at another end of the second link; and a first elastic resistance unit imparting elasticity in a rotating direction to the second joint portion.

BRIEF DESCRIPTION OF THE DRAWINGS

Preferred exemplary embodiments of the present invention will be described in detail based on the following figures, wherein.

DETAILED DESCRIPTION OF THE INVENTION

Exemplary Embodiment 1

Figure 1:
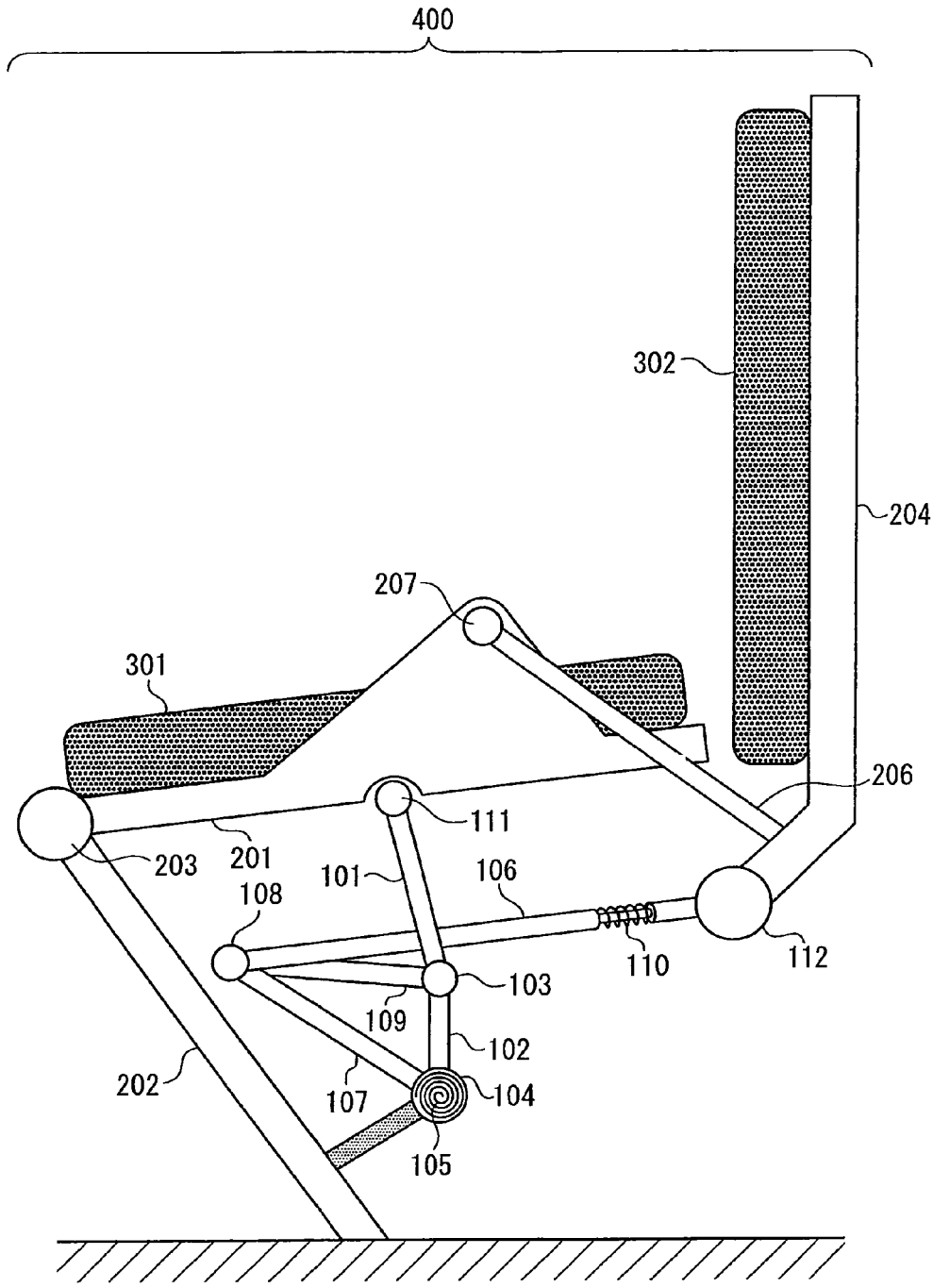
FIG. 1 is a schematic side view showing the structure of a chair 400 relating to exemplary embodiment 1.

FIG. 1 is a schematic side view showing the structure of a chair 400 relating to exemplary embodiment 1 of the present invention. Here, only portions that are necessary for explaining the structure of the chair 400 are illustrated. Hereinafter, first, the overall structure of the chair 400 will be described, and thereafter, details of the link mechanism of the chair 400 will be explained.

The chair 400 has a seat surface portion 301 and a back surface portion 302.

The seat surface portion 301 is fixed on a sixth link 201 that will be described later.

The back surface portion 302 is fixed on an eighth link 204 that will be described later.

The sixth link 201 supports the seat surface portion 301 from below, and is connected to a seventh link 202 that will be described later via a fifth joint portion 203 that will be described later.

Further, the portion of the sixth link 201 that corresponds to the side surface of a user who is seated on the seat surface portion 301 rises upwardly. This upwardly-rising portion is connected to the eighth link 204 via a ninth link 206 that will be described later.

The seventh link 202 functions as a base portion that supports the self-weight of the chair 400 and the body weight of the user who is seated on the seat surface portion 301. A base portion may be provided separately from the seventh link 202, and connected to the seventh link 202.

The fifth joint portion 203 is structured by, for example, a hinge joint, and rotatably connects the sixth link 201 and the seventh link 202. The fifth joint portion 203 does not have means for imparting elastic force, such as a rotary spring or the like. The body weight of the user who is seated on the seat surface portion 301 is supported by the link mechanism that will be described later imparting elasticity to the chair 400.

The eighth link 204 is disposed at the rear of the back surface portion 302, and, via the back surface portion 302 and from the rear, supports the back of the user who is seated on the seat surface portion 301.

The eighth link 204 is connected, via the ninth link 206 that will be described later, to the sixth link 201 at a position corresponding to the side surface of the user. Moreover, the eighth link 204 is connected to a third link 106 that will be described later via a sixth joint portion 112 that will be described later.

The ninth link 206 is fixedly connected to the eighth link 204.

The ninth link 206 is connected to the sixth link 201 via a seventh joint portion 207 that will be described hereinafter.

The seventh joint portion 207 is structured by a hinge joint for example, and rotatably connects the sixth link 201 and the ninth link 206.

Due to the structure of the above-described sixth link 201 and ninth link 206, the seventh joint portion 207 is disposed at a position that is apart, by a predetermined distance forward, from the eighth link 204 and the back surface portion 302.

The position of the seventh joint portion 207 approximately corresponds to the position of the hip joint of the user when the user is seated on the seat surface portion 301.

The overall structure of the chair 400 has been described above.

Next, the link mechanism of the chair 400 will be described.

The bottom surface of the sixth link 201 is supported from beneath at a first link 101. One end of the first link 101 and the sixth link 201 are connected at a fourth joint portion 111.

The fourth joint portion 111 is structured by a hinge joint for example, and rotatably connects the bottom surface side of the first link 101 and the sixth link 201.

A second link 102 is connected via a first joint portion 103 to the other end of the first link 101.

One end of the second link 102 is connected to the first joint portion 103, and the other end is connected to a second joint portion 104 that will be described hereinafter.

The second joint portion 104 is connected to the aforementioned seventh link 202 via an appropriate connecting mechanism.

A first elastic resistance unit 105, that imparts elastic force in a rotating direction to the second joint portion 104, is provided at the second joint portion 104. The first elastic resistance unit 105 can be structured by, for example, a torsion spring or the like.

The third link 106 is rotatably connected to the above-described eighth link 204 via the sixth joint portion 112 that will be described later.

The third link 106 is disposed beneath the sixth link 201, substantially parallel to the sixth link 201. One end of the third link 106 is connected to the eighth link 204 via the sixth joint portion 112. Further, the third link 106 functions to push the eighth link rightward in FIG. 1 (in the direction of the back surface of the user), due to the repelling elastic force imparted by a second elastic resistance unit 110 that will be described hereinafter.

The second elastic resistance unit 110 is structured by, for example, a repulsion spring or the like, and imparts repelling elastic force to the third link 106, and functions to push the eighth link rightward in FIG. 1. The specific operation will be described in FIGS. 2A through 2C that will be explained later.

The sixth joint portion 112 is structured by a hinge joint for example, and rotatably connects the eighth link 204 and the third link 106.

A third joint portion 108 is provided at the other end of the third link 106.

The third joint portion 108 and the second joint portion 104 are connected by a fourth link 107.

The third joint portion 108 and the first joint portion 103 are connected by a fifth link 109.

The link mechanism of the chair 400 has been described above.

Next, operation of the respective portions when a user sits on the seat surface portion 301 of the chair 400 will be described.

Figure 2A:
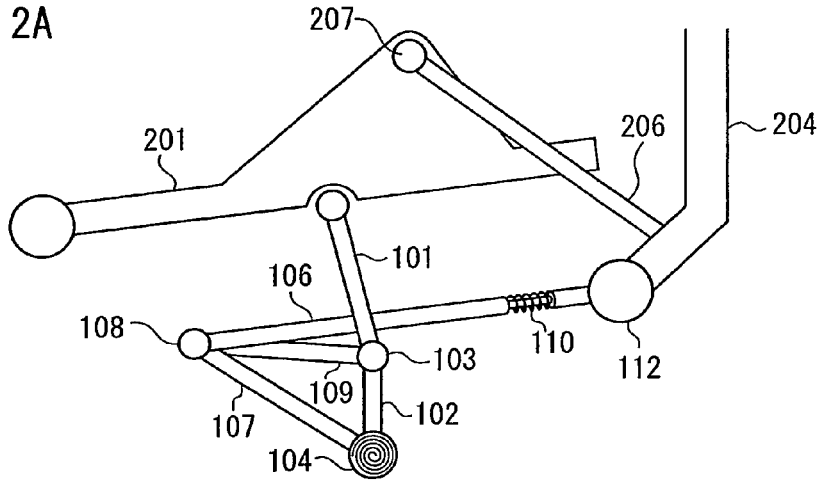
FIGS. 2A through 2C are drawings showing changes in respective portions at a time when a user sits on a seat surface portion 301 and rests against a back surface portion 302.
Figure 2B:
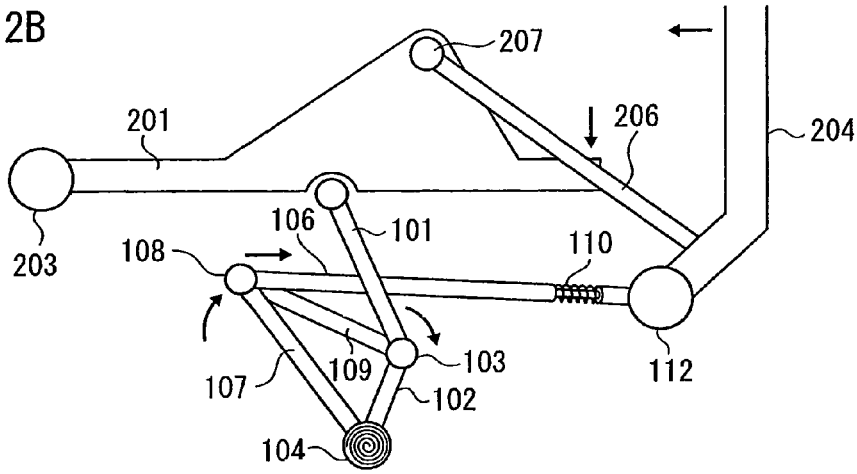
Figure 2C:
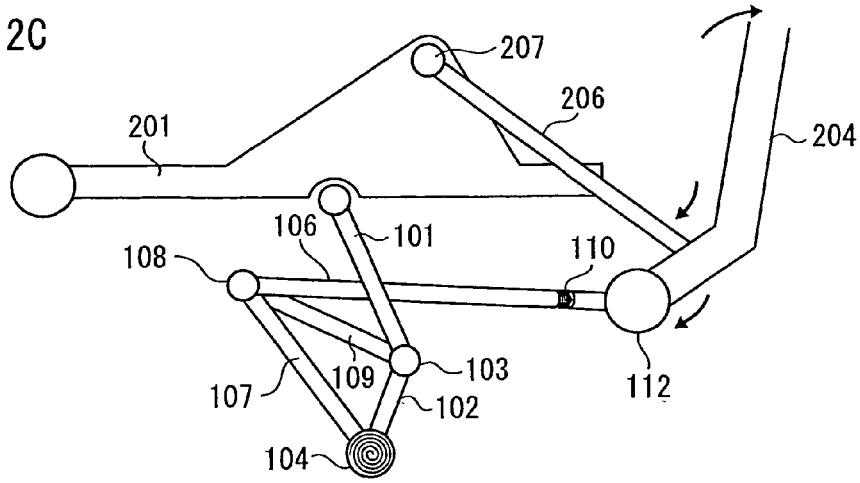

FIGS. 2A through 2C are drawings showing changes in the respective portions at a time when a user sits on the seat surface portion 301 and rests against the back surface portion 302. Here, among the respective portions shown in FIG. 1, only the portions that are needed for explanation are selectively illustrated.

FIG. 2A shows a state before the user sits on the seat surface portion 301. The state shown in FIG. 2A is similar to the state of the respective portions shown in FIG. 1.

FIG. 2B shows a state when the user sits on the seat surface portion 301, and before he/she rests against the back surface portion 302. The processes from FIG. 2A to FIG. 2B will be described hereinafter.

(1) When the user sits on the seat surface portion 301, the sixth link 201 rotates with the fifth joint portion 203 being the fulcrum, so as to sink-in. At this time, the first link 101 that supports the bottom surface side of the sixth link 201 is pushed downward.

(2) The first link 101 pushes the first joint portion 103 downward.

(3) Accompanying the first joint portion 103 being pushed downward, the second link 102 rotates downward around the second joint portion 104. Further, the second joint portion 104 rotates clockwise as seen from the front surface of FIG. 2B.

(4) When the second joint portion 104 rotates clockwise, the elastic force of the first elastic resistance unit 105 repels this and works counterclockwise, and elastic force in a direction of pushing the second link 102 and the first link 101 upward is applied.

(5) At the point in time when the body weight of the user and this elastic force are in equilibrium, the rotation of the sixth link 201 stops, and the sinking-in of the seat surface portion 301 stops. At this point in time, the sit-in posture of the user is determined.

(6) On the other hand, accompanying the first joint portion 103 being pushed downward, the third joint portion 108, the fourth link 107, and the fifth link 109 receive rotational force in the clockwise direction, as seen from the front surface of FIG. 2B, around the second joint portion 104.

(7) Accompanying the third joint portion 108 and the like rotating clockwise around the second joint portion 104, the third link 106 pushes the sixth joint portion 112 and the eighth link 204 rearward.

Accompanying this, the eighth link 204 rotates counterclockwise in FIG. 2B around the seventh joint portion 207. Further, the angle between the sixth link 201 and the eighth link 204 narrows.

Due thereto, for the user who is seated on the seat surface portion 301, there is the effect of the back surface portion 302 approaching his/her back and automatically fitting thereto. Namely, merely by sitting on the seat surface portion 301, the user obtains an optimal seated posture, and does not need to push the back surface portion 302 in order to adjust the seated posture.

The operations of the respective portions at the time when the user sits on the seat surface portion 301 have been described above.

FIG. 2C shows a state at the time when the user rests against the back surface portion 302, after having sat on the seat surface portion 301. Hereinafter, the processes from FIG. 2B to FIG. 2C will be described.

(8) When the user rests against the back surface portion 302, the eighth link 204 is, with the seventh joint portion 207 being the center of rotation, supported by the ninth link 206 and rotates clockwise as seen from the front surface of FIG. 2C.

(9) When the eighth link 204 rotates clockwise, the sixth joint portion 112 is pushed substantially leftward (in the direction of the front surface of the user) as seen from the front surface of FIG. 2C.

(10) Accompanying this, the second elastic resistance unit 110 is pushed, and repelling elastic force toward the right in FIG. 2C (in the direction of the back surface of the user) is generated.

(11) At the point in time when the force at which the user rests against the back surface portion 302 and this repelling elastic force are in equilibrium, the tilting of the eighth link 204 stops, and the back-resting posture of the user is determined.

(12) Note that, in the state of FIG. 2B, when the user sits on the seat surface portion 301, if he/she sits-in in a state in which his/her back contacts the back surface portion 302, the force by which the back of the user pushes the back surface portion 302 and the force by which the third link 106 pushes the eighth link 204 oppose one another, and the second elastic resistance unit 110 is compressed.

At the point in time when the force by which the elastic force or the like, that is generated at the second elastic resistance unit 110 due thereto, pushes the eighth link 204 rearward and the force by which the back of the user pushes the back surface portion 302 are in equilibrium, the position of the back surface portion 302, i.e., the seated posture of the user, is determined.

(13) Further, there can be a structure in which the coefficient of elasticity of the second elastic resistance unit 110 is adjusted, and the third link 106 is pushed leftward in FIGS. 2B and 2C when the user rests against the back surface portion 302. In this case, rotational force works in the direction of the first link 101 pushing the sixth link 201 upward from beneath, and the back surface portion 302 and the seat surface portion 301 operate interlockingly.

The operations of the respective portions at the time when the user sits on the seat surface portion 301 of the chair 400 have been described above.

Note that, from the standpoint of ease of explanation, in FIGS. 1 and 2, the link mechanism is drawn so as to be able to be seen from the side surface of the chair 400. However, as needed, the link mechanism may be covered by a casing or the like such that the user cannot see the mechanism portions.

Further, the link mechanism may be formed as a module such that it can be removed from the chair 400, and can be structured such that designing, production, repair, replacement and the like can be carried out with the link mechanism for a chair being a single unit.

The link mechanism for a chair can include the sixth link 201, the seventh link 202 and other peripheral members. Which peripheral parts should be included in the link mechanism for a chair may be determined appropriately in accordance with the extent to which the link mechanism for a chair is formed as a module, and the like.

As described above, in the chair 400 relating to exemplary embodiment 1, as explained in FIG. 2B through FIG. 2C, the seat surface portion 301 and the back surface portion 302 change interlockingly accompanying the sitting of the user.

Accordingly, the user can always assume an optimal seated posture.

Further, the chair 400 relating to present exemplary embodiment 1 has, beneath the seat surface portion 301, the link mechanism that is described in FIG. 1 and FIG. 2.

By adjusting the coefficients of elasticity of the first elastic resistance unit 105 and the second elastic resistance unit 110 that are provided at the link mechanism, the strengths of the forces needed when the seat surface portion 301 is sunk-in and the back surface portion 302 is inclined can be adjusted.

Due thereto, the seating comfort and the feeling of use of the chair 400 can be adjusted arbitrarily.

Further, at the chair 400 relating to present exemplary embodiment 1, the eighth link 204 rotates around the seventh joint portion 207.

Because the seventh joint portion 207 is at a position that approximately corresponds to the hip joint of the user who sits on the seat surface portion 301, the eighth link 204 and the back surface portion 302 can be rotated around the hip joint of the user.

Therefore, the rotating operation of the back surface portion 302 is made to appropriately suit the body structure of the user, and can provide a good sitting feeling.

Exemplary Embodiment 2

Figure 3:
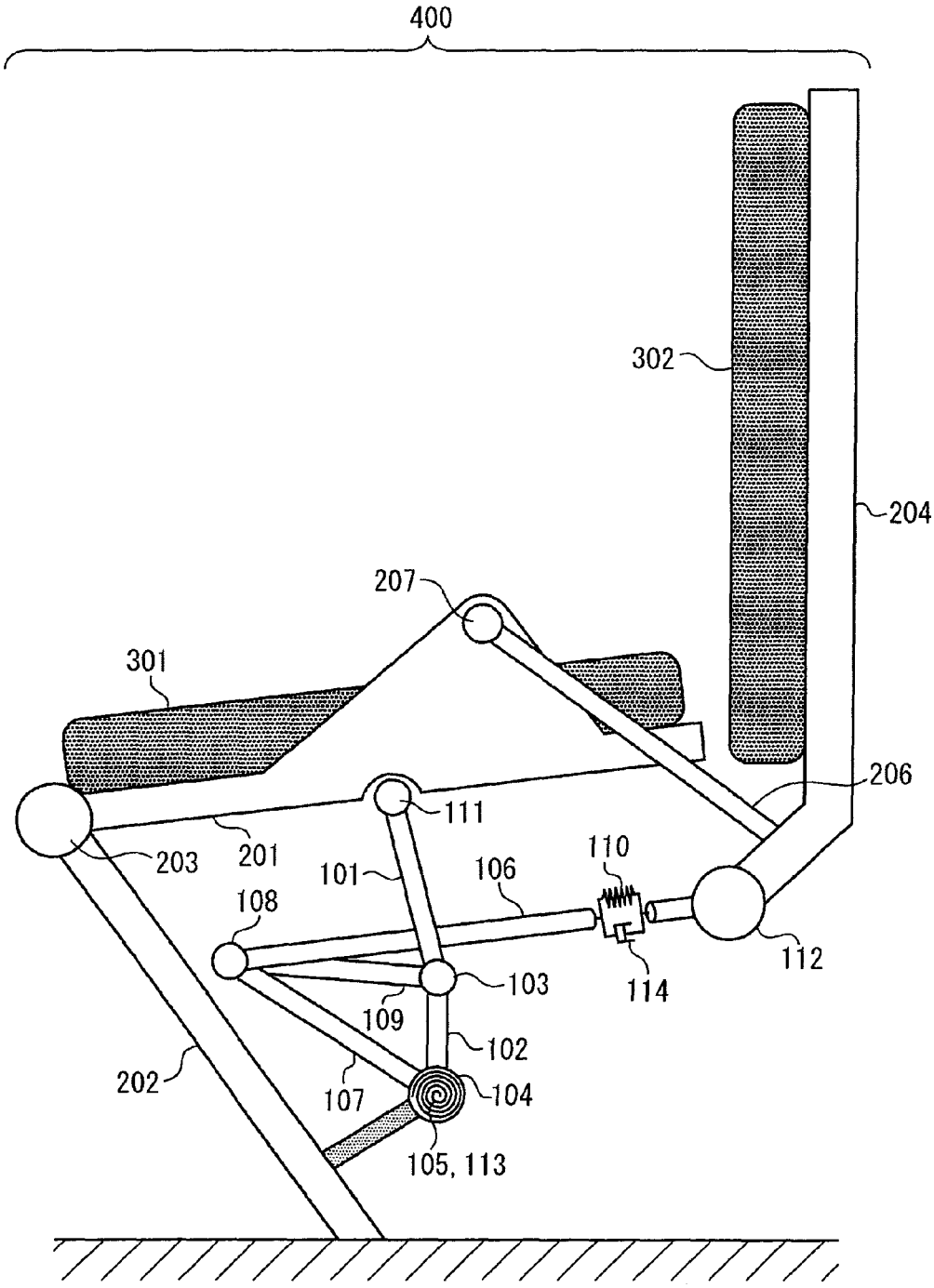
FIG. 3 is a schematic side view showing the structure of the chair 400 relating to exemplary embodiment 2.

FIG. 3 is a schematic side view showing the structure of the chair 400 relating to exemplary embodiment 2 of the present invention.

The chair 400 relating to present exemplary embodiment 2 is equipped with a first viscous resistance unit (a first damper) 113 that imparts viscous resistance to the second joint portion 104, and a second viscous resistance unit 114 that imparts viscous resistance to the third link 106.

Because the other structures are similar to those described in FIG. 1 of exemplary embodiment 1, description hereinafter will center on the points that differ.

The first viscous resistance unit 113 has the function of, when rotational force is applied to the first elastic resistance unit 105, damping the rotational force.

The second viscous resistance unit (a second damper) 114 has the function of, when pushing force is applied to the second elastic resistance unit 110, damping the pushing force.

The first viscous resistance unit 113 and the second viscous resistance unit 114 can be structured by oil-type shock absorbers for example.

The first viscous resistance unit 113 and the second viscous resistance unit 114 can be structured as portions of the link mechanism for a chair described in exemplary embodiment 1.

Because the chair 400 relating to present exemplary embodiment 2 is equipped with the first viscous resistance unit 113, the sinking-in at the time when the user sits on the seat surface portion 301 can be made to be gentle, and a soft sitting-in feeling can be provided.

Further, because the chair 400 relating to present exemplary embodiment 2 is equipped with the second viscous resistance unit 114, the falling-in at the time when the user rests against the back surface portion 302 can be made to be gentle, and a soft back-resting feeling can be provided.

Exemplary Embodiment 3

Exemplary embodiments 1 and 2 are structured such that, by using the elastic force that the first elastic resistance unit 105 imparts to the second joint portion 104, an upward repelling force is imparted to the seat surface portion 301, and the seat surface portion 301 resists the body weight of the user.

However, at a time when a very heavy object is placed on the seat surface portion 301, or the like, there is the possibility that the elastic force of the first elastic resistance unit 105 cannot withstand this, and the second joint portion 104 and the like rotate past the allowable range of rotation and break.

Thus, in exemplary embodiment 3 of the present invention, a structure is described that limits the range of downward sinking-in of the sixth link 201 and the like to a given range.

Figure 4:
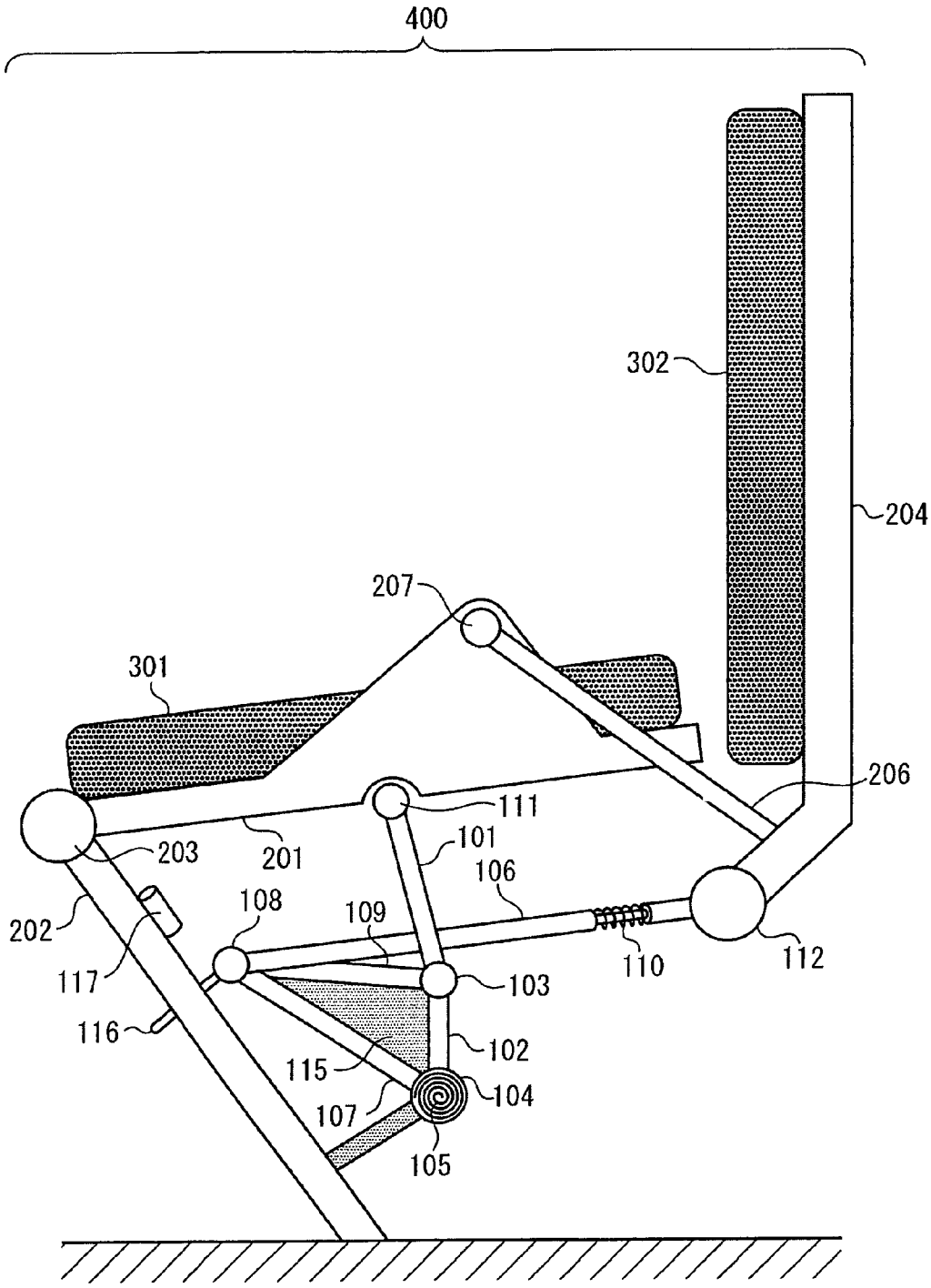
FIG. 4 is a schematic side view showing the structure of the chair 400 relating to exemplary embodiment 3.

FIG. 4 is a schematic side view showing the structure of the chair 400 relating to present exemplary embodiment 3.

The chair 400 relating to present exemplary embodiment 3 is equipped with, in addition to the structures described in exemplary embodiments 1 and 2, a reinforcing plate 115, and anchor piece 116 and first stoppers 117. The other structures are similar to exemplary embodiments 1 and 2.

Note that FIG. 4 illustrates an example that has the aforementioned respective portions in addition to the structure of FIG. 1 that was described in exemplary embodiment 1. Hereinafter, the aforementioned respective portions are described by using FIG. 4.

The reinforcing plate 115 fills-in the triangular space that is formed between the second link 102, the fourth link 107 and the fifth link 109, and maintains constant the relative positional relationships of these three links. At the same time, the relative positional relationships of the first joint portion 103, the second joint portion 104 and the third joint portion 108 are always maintained the same by the reinforcing plate 115.

Due thereto, even when the user sits on the seat surface portion 301 and the aforementioned respective links and respective joint portions rotate, the relative positional relationships of the first joint portion 103, the second joint portion 104 and the third joint portion 108 are maintained in the same triangular shape.

The anchor piece 116 is structured as a plate-shaped member that projects-out from the third joint portion 108 toward the front of the chair 400. Details thereof are described anew in FIG. 5 that will be described later.

The first stoppers 117 are structured by solid-cylindrical rubber pieces, and are disposed at the inner side (the right side in FIG. 4) of the seventh link 202, at the upper side of the anchor piece 116.

The reinforcing plate 115 corresponds to the "relative position fixing mechanism" in present exemplary embodiment 3.

Further, the anchor piece 116 corresponds to the "first rotation limiting unit".

Figure 5:
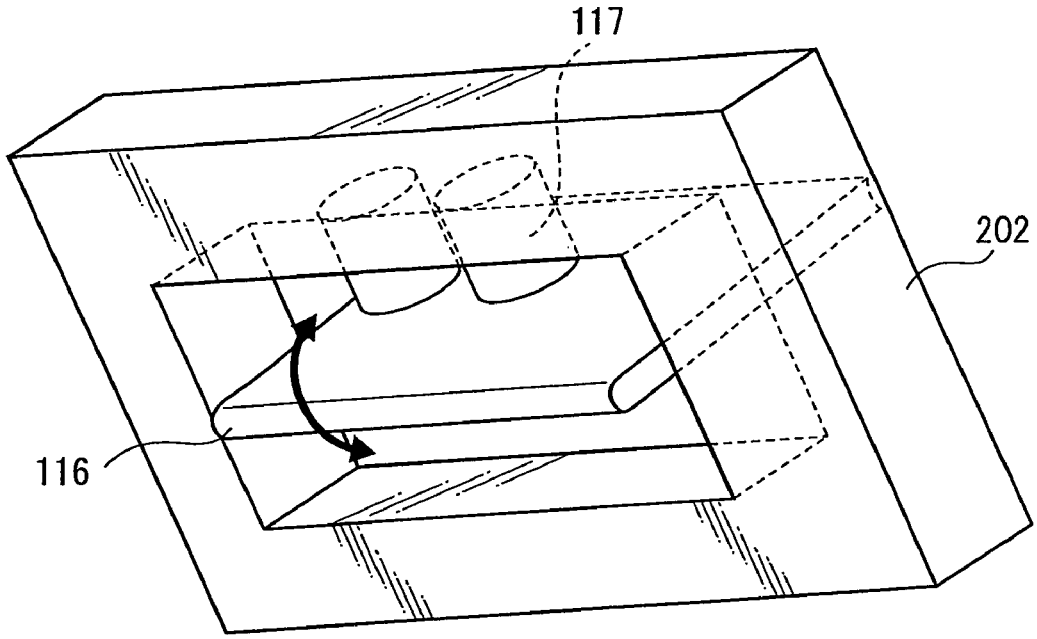
FIG. 5 is a transparent perspective view of the periphery of an anchor piece 116.

FIG. 5 is a transparent perspective view of a periphery of the anchor piece 116. This is a drawing in which the periphery of the anchor piece 116 is viewed diagonally from the front and from the lower side of the chair 400.

The anchor piece 116 is structured in the shape of a plate that projects-out further forward than the seventh link 202.

The first stoppers 117 are disposed at the inner side of the seventh link 202, at the upper side of the anchor piece 116.

When the user sits on the seat surface portion 301, the reinforcing plate 115 and peripheral members rotate clockwise as seen from the front surface of FIG. 4.

Accompanying this rotation, the anchor piece 116 similarly rotates clockwise as seen from the front surface of FIG. 4.

However, because the first stoppers 117 are disposed above and below the anchor piece 116, the range over which the anchor piece 116 can rotate upward in FIG. 5 is limited to up to the position at which the first stoppers 117 exist.

On the other hand, the relative positional relationships of the first joint portion 103, the second joint portion 104 and the third joint portion 108 are maintained in the same triangular shape by the reinforcing plate 115.

Therefore, at the point in time when the anchor piece 116 contacts the first stoppers 117 and rotation is stopped, the reinforcing plate 115 and also the peripheral members that are connected thereto cannot rotate any further upward in FIG. 5.

Accordingly, the sinking-in of the first link 101 and the sixth link 201 stops at that point in time, and the sitting-in position of the user is determined.

Figure 6A:
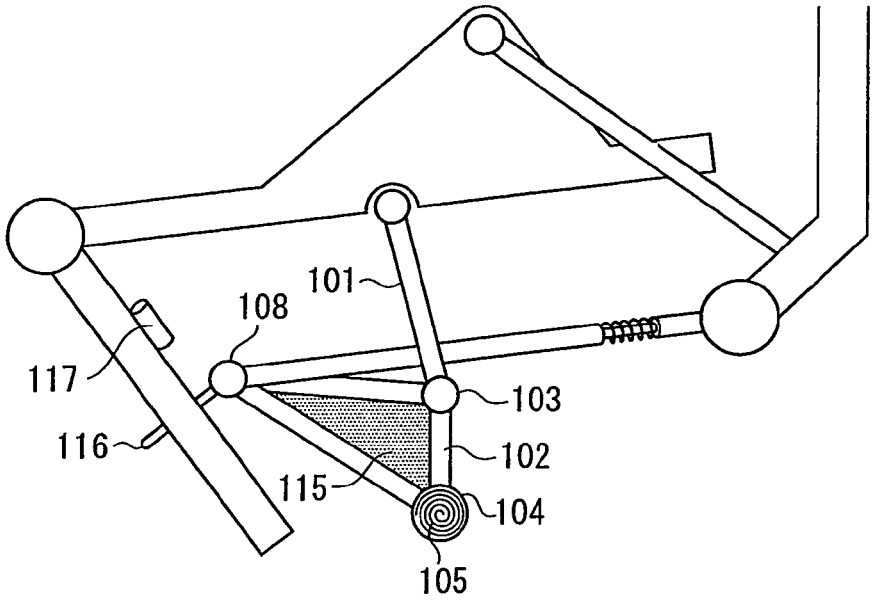
FIGS. 6A and 6B are schematic side views showing states in which the anchor piece 116 and first stoppers 117 contact, and stop rotation of a reinforcing plate 115 and peripheral members.
Figure 6B:
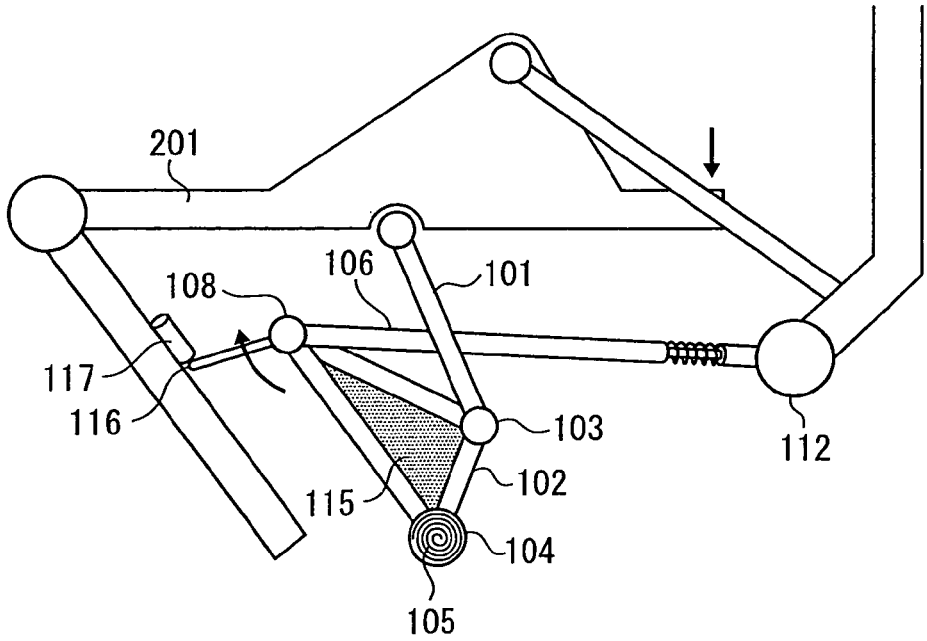

FIGS. 6A and 6B are schematic side views showing states in which the anchor piece 116 and the first stoppers 117 contact, and stop rotation of the reinforcing plate 115 and the peripheral members.

FIG. 6A shows a state before the user has sat down on the seat surface portion 301. The state shown in FIG. 6A is similar to the state of the respective portions shown in FIG. 4.

FIG. 6B shows a state in which the user has sat down on the seat surface portion 301, but before the user rests against the back surface portion 302. Hereinafter, operation of the respective portions will be described.

(1) When the user sits down on the seat surface portion 301, as explained in FIG. 2B, the respective structural members such as the first joint portion 103, the second joint portion 104, the third joint portion 108 and the like rotate clockwise as seen from the front surface of FIG. 6B. At this time, the relative positional relationships of the respective structural members are maintained in a fixed triangular shape by the reinforcing plate 115.

(2) Accompanying the rotation of the respective structural members, the anchor piece 116 as well rotates clockwise.

(3) When the respective structural members and the anchor piece 116 rotate a given extent, the anchor piece 116 contacts the first stoppers 117.

(4) Due to the working of the anchor piece 116 and the first stoppers, the respective structural members cannot rotate any further clockwise.

(5) Accordingly, the sinking-in of the seat surface portion 301 as well stops at that point in time.

The working of the anchor piece 116 and the first stoppers 117 have been described above.

Note that, although the shape of the reinforcing plate 115 is triangular in present exemplary embodiment 3, the shape does not necessarily have to be triangular, and may be an arbitrary shape provided that it can maintain constant the relative positional relationships of the respective portions that it connects.

Further, in present exemplary embodiment 3, the first stoppers 117 are formed of rubber and are solid-cylindrical, from the standpoint of protecting the members and the like, however, the first stoppers 117 do not necessarily have to be solid-cylindrical and rubber, and another member can be used provided that it is a member that can stop the rotation of the anchor piece 116.

As described above, in present exemplary embodiment 3, the relative positional relationships of the first joint portion 103, the second joint portion 104 and the third joint portion 108 are maintained constant by using the reinforcing plate 115.

Thus, when the user sits on the seat surface portion 301, the second link 102 is pushed downward while the angle between the second link 102 and the fourth link 107 is maintained constant. Therefore, the elastic force of the first elastic resistance unit 105 is applied reliably.

Further, in present exemplary embodiment 3, the anchor piece 116 and the first stoppers 117 are provided, and when the second joint portion 104 rotates clockwise up to a predetermined range, the anchor piece 116 and the first stoppers 117 contact, and restrain rotation.

Therefore, even in a case in which, for example, a very heavy object is placed on the seat surface portion 301, there is no concern that the respective portions will rotate past the allowable range and break or the like.

Exemplary Embodiment 4

In exemplary embodiment 4 of the present invention, a structure is described in which a constant, initial repelling force is imparted in advance upward from beneath the seat surface portion 301, so as to adjust the sitting feeling when the user sits on the seat surface portion 301.

Figure 7:
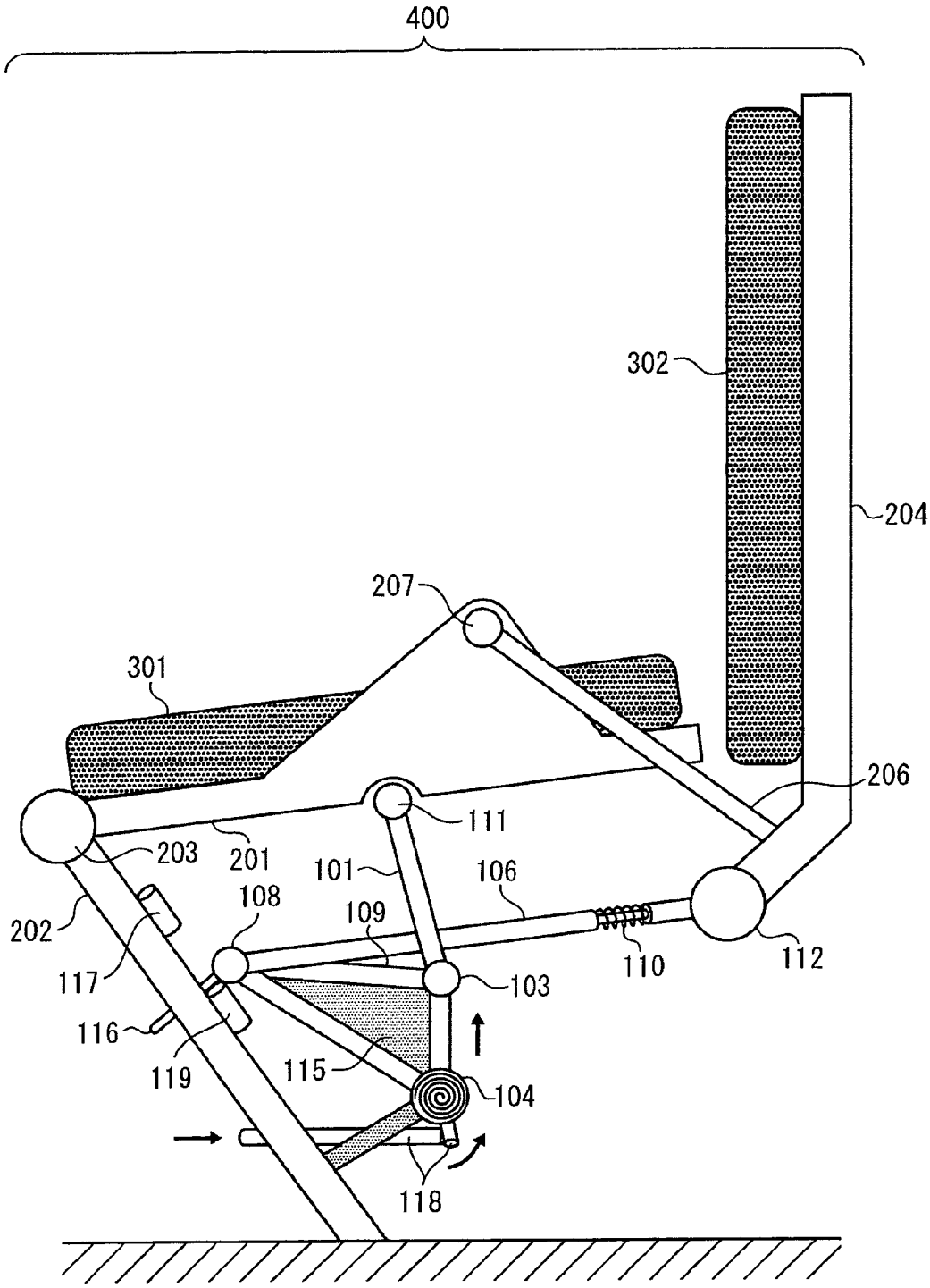
FIG. 7 is a schematic side view showing the structure of the chair 400 relating to exemplary embodiment 4.

FIG. 7 is a schematic side view showing the structure of the chair 400 relating to present exemplary embodiment 4.

The chair 400 relating to present exemplary embodiment 4 newly has, in addition to the structures described in exemplary embodiment 3, a pretensioner 118 and second stoppers 119. The other structures are similar to those of exemplary embodiment 3.

Note that some of the reference numerals are omitted from FIG. 7 for convenience of drawing.

The pretensioner 118 is a mechanism that restrains the second joint portion 104 and the first elastic resistance unit 105 in a state in which they have rotated by a predetermined amount, in a direction of pushing the first link 101 upward (upward in FIG. 7).

A portion of the pretensioner 118 is formed by a projection that projects-out in the centrifugal direction of the second joint portion 104.

The remaining portion of the pretensioner 118 pushes this projection by a predetermined amount by using a means such as a push-in screw or the like, from the front surface of the seventh link 202 (the left side as seen from the front surface of FIG. 7) toward the rear (the right side as seen from the front surface of FIG. 7).

Details of the operation of the pretensioner 118 will be described anew in FIGS. 9A and 9B that will be described later.

The second stoppers 119 are structured by solid-cylindrical rubber pieces and are disposed at the inner side (the right side in FIG. 7) of the seventh link 202, at positions supporting the anchor piece 116 from below.

Details of the working of the second stoppers 119 will be described anew in FIGS. 9A and 9B that will be described later.

The second stoppers 119 correspond to the "second rotation limiting unit" in present exemplary embodiment 4.

Figure 8:
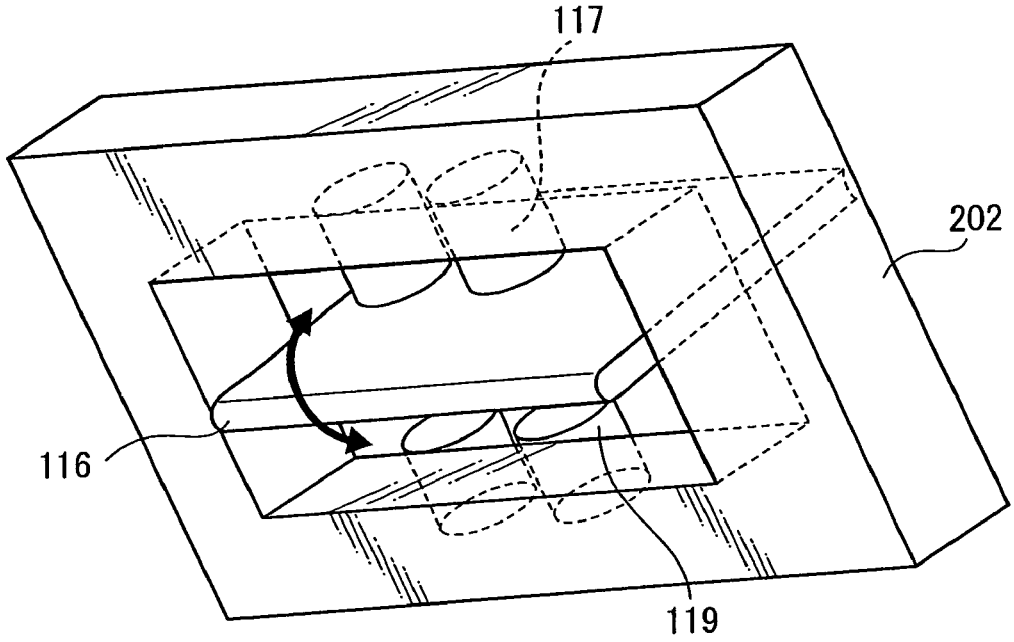
FIG. 8 is a transparent perspective view of the periphery of the anchor piece 116.

FIG. 8 is a transparent perspective view of the periphery of the anchor piece 116. This is a drawing in which the periphery of the anchor piece 116 is viewed diagonally from the front and from the lower side of the chair 400.

The point that the second stoppers 119 are disposed at the lower side of the anchor piece 116 is what is different from FIG. 5 that was described in exemplary embodiment 3. Due to the working of the second stoppers 119, downward rotation of the anchor piece 116 is limited to within a predetermined range.

Figure 9A:
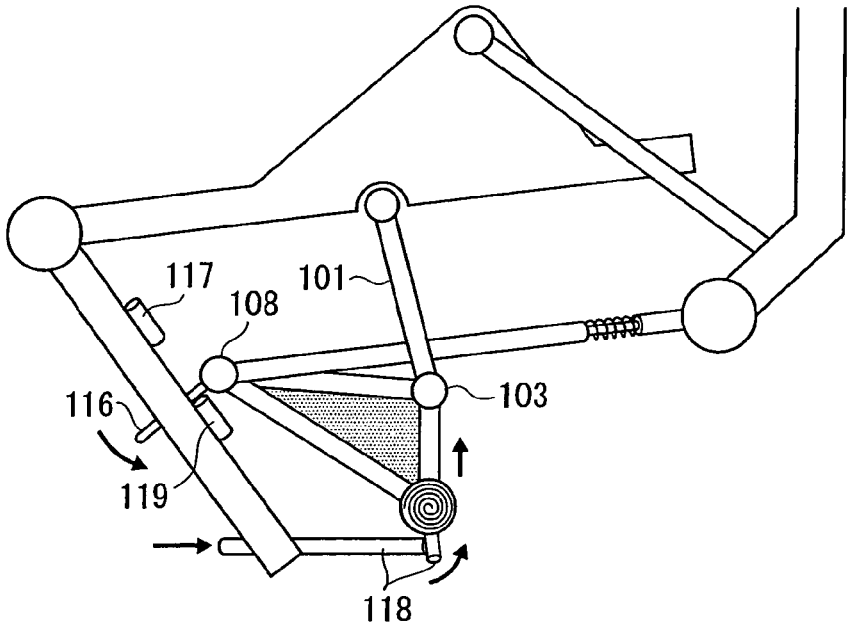
FIGS. 9A and 9B are schematic side views showing states in which the anchor piece 116 and second stoppers 119 contact, and stop rotation of the reinforcing plate 115 and peripheral members.
Figure 9B:
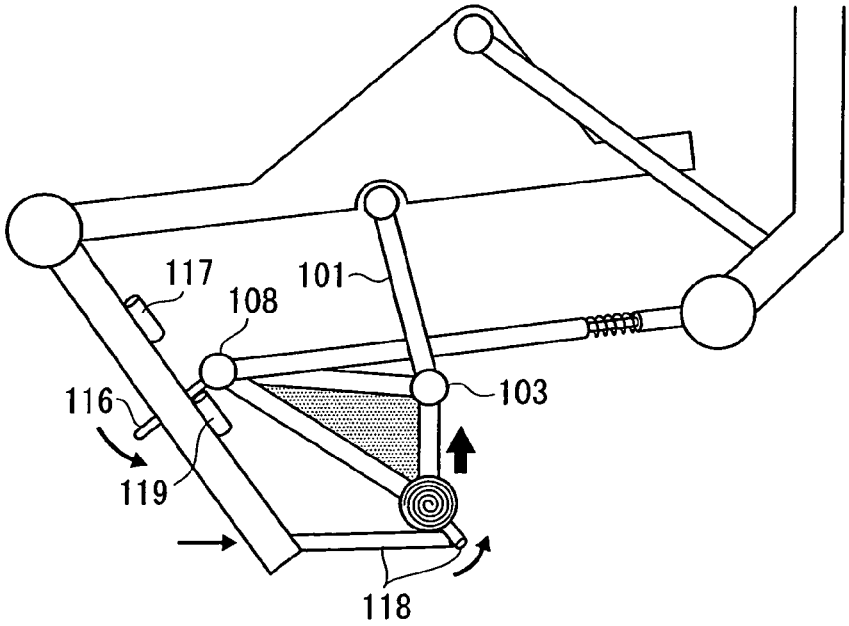

FIGS. 9A and 9B are schematic side views showing states in which the anchor piece 116 and the second stoppers 119 contact, and stop rotation of the reinforcing plate 115 and peripheral members.

FIG. 9A shows a state before the user has sat down on the seat surface portion 301. The state shown in FIG. 9A is similar to the state of the respective portions shown in FIG. 7. Hereinafter, the operations of the respective portions will be described.

(1) When the push-in screw portion of the pretensioner 118 is pushed-in toward the right in FIGS. 9A and 9B, the push-in screw pushes the projecting portion that projects from the second joint portion 104, and rotational force in the direction of pushing the first link 101 upward is applied.

(2) As a result, pressure is applied in the directions shown by the arrows in FIGS. 9A and 9B, and force is applied in a direction of pushing the first link 101 upward from below. Therefore, when the user sits on the seat surface portion 301, a constant resistance force is applied from beneath. Therefore, by adjusting this resistance force, the sitting feeling can be adjusted.

(3) When pressure is applied in the directions shown by the arrows in FIGS. 9A and 9B due to the working of the pretensioner 118, the anchor piece 116 and peripheral members thereof rotate downward (counterclockwise as seen from the front surfaces of FIGS. 9A and 9B). In order to keep this rotation within a predetermined range, the second stoppers 119 are disposed at the appropriate position, and are made to contact the anchor piece 116.

(4) At the point in time when the anchor piece 116 and the second stoppers 119 contact, rotation of the anchor piece 116 and the peripheral members thereof stops. At this point in time, the positions of the sixth link 201 and the seat surface portion 301 and the like are determined.

(5) When the push-in screw portion of the pretensioner 118 is pushed-in further, the anchor piece 116 and the peripheral members thereof do not rotate any further, but the first elastic resistance unit 105 is pushed further. Therefore, the repelling elastic force of the first elastic resistance unit 105 increases, and the force that pushes the seat surface portion 301 upward from beneath via the first link 101 and the sixth link 201 at the time when the user sits on the seat surface portion 301, increases.

(6) Namely, by adjusting the push-in amount of the push-in screw portion of the pretensioner 118, the resistance force that is received from beneath at the time when the user sits on the seat surface portion 301 can be adjusted, and the sitting feeling can be adjusted.

As described above, in present exemplary embodiment 4, an initial elastic force is imparted to the first elastic resistance unit 105 by using the pretensioner 118, and force that pushes the first link 101 and the sixth link 201 from beneath is applied.

Due thereto, resistance force is applied from beneath at the time when the user sits on the seat surface portion 301, and a sitting feeling can be imparted.

Further, in present exemplary embodiment 4, the downward rotation of the anchor piece 116 and the peripheral members thereof is limited to within a predetermined range by using the second stoppers 119.

Due thereto, even if the pretensioner 118 imparts an initial elastic force to the first elastic resistance unit 105 and causes rotation, the rotation stops in accordance with the position of the second stoppers 119. Therefore, the initial positions of the seat surface portion 301 and the like can be adjusted arbitrarily.

Moreover, in present exemplary embodiment 4, by adjusting the push-in amount of the push-in screw of the pretensioner 118, the initial elastic force of the first elastic resistance unit 105 can be adjusted, and the resistance force at the time when the user sits on the seat surface portion 301 can be adjusted.

Due thereto, the sitting feeling of the seat surface portion 301 can be adjusted arbitrarily. Further, because the push-in amount of the push-in screw can be easily adjusted, the user can adjust it by him/herself and can obtain a desired sitting feeling.

Exemplary Embodiment 5

Exemplary embodiment 5 of the present invention describes a structure in which the link mechanism of the chairs 400 described in exemplary embodiments 1 through 4 is simplified. Members that are similar to those described in exemplary embodiments 1 through 4 are denoted by the same reference numerals and description thereof is omitted, and description centers on the points that are different.

Figure 10:
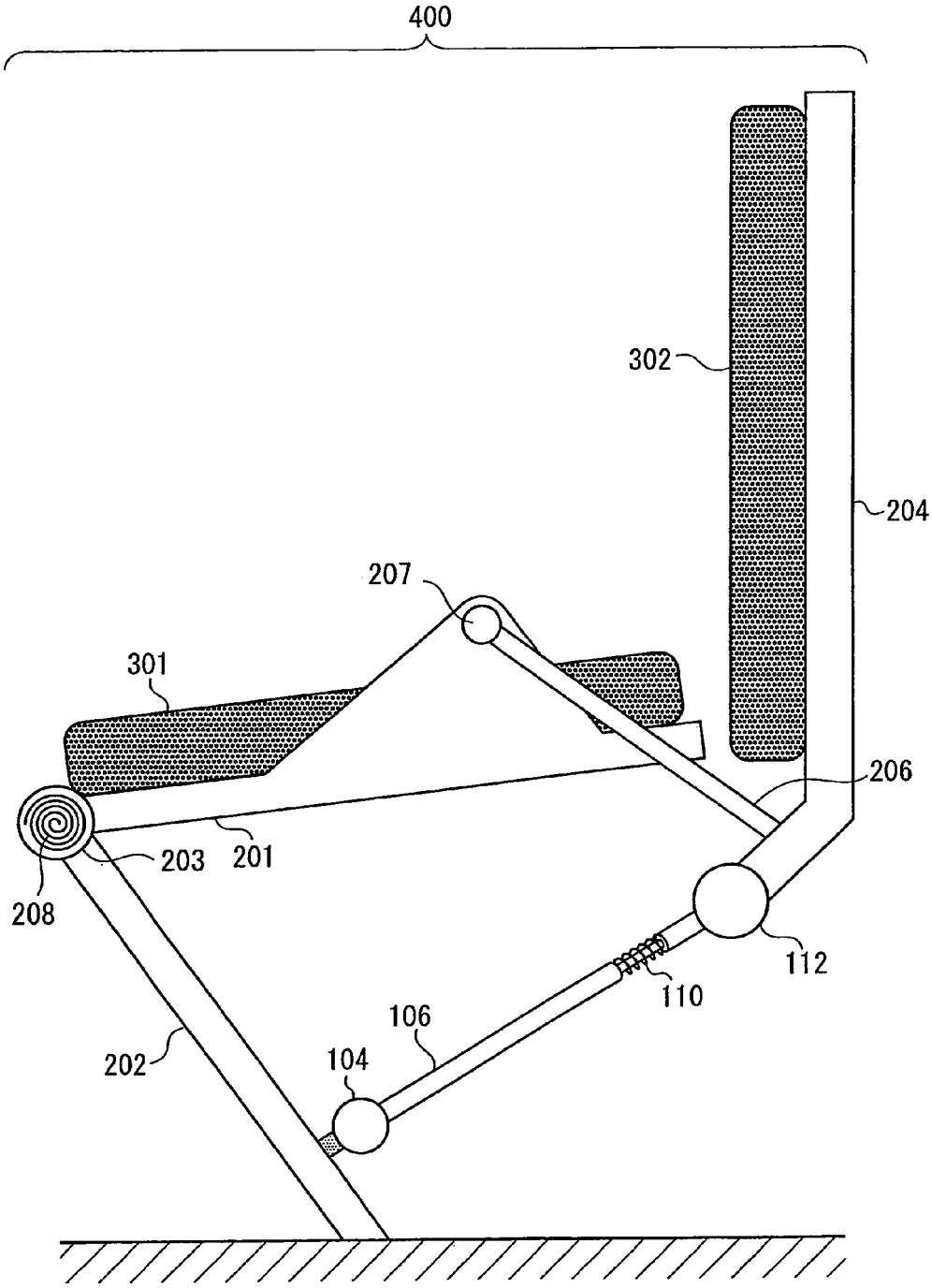
FIG. 10 is a schematic side view showing the structure of the chair 400 relating to exemplary embodiment 5.

FIG. 10 is a schematic side view showing the structure of the chair 400 relating to present exemplary embodiment 5.

With respect to the seat surface portion 301, the back surface portion 302, the sixth link 201, the seventh link 202, the fifth joint portion 203 and the seventh joint portion 207, the chair 400 relating to present exemplary embodiment 5 has structures that are similar to those described in exemplary embodiments 1 through 4.

However, as compared with exemplary embodiments 1 through 4, the structure of the link mechanism of the chair 400 is simplified. Further, the second joint portion 104 does not have the first elastic resistance unit 105. Hereinafter, description will center on the structure of the link mechanism.

The second joint portion 104 is connected to the seventh link 202 via an appropriate connecting mechanism.

A third elastic resistance unit 208, that imparts elastic force in the direction of rotation of the fifth joint portion 203, is provided at the fifth joint portion 203. The third elastic resistance unit 208 can be structured by, for example, a torsion spring or the like.

The relationships of connection of the eighth link 204, the sixth joint portion 112 and the third link 106 are similar to those in exemplary embodiments 1 through 4.

Differently than in exemplary embodiments 1 through 4, the first link 101, the second link 102, the first joint portion 103, the fourth link 107, the third joint portion 108, the fifth link 109 and the fourth joint portion 111 do not exist in present exemplary embodiment 5. By omitting these structures, the structure of the chair 400 can be simplified.

The structure of the chair 400 relating to present exemplary embodiment 5 has been described above.

Next, operations of the respective portions at the time when the user sits on the seat surface portion 301 of the chair 400 will be described.

Figure 11A:
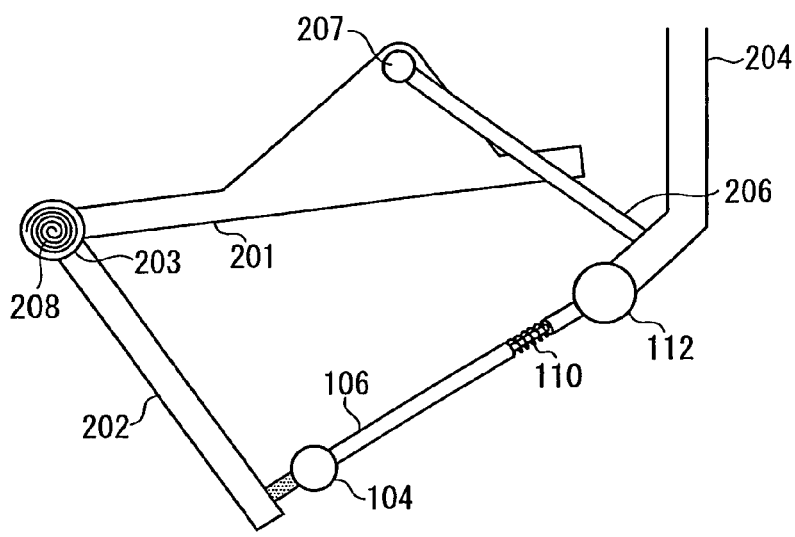
FIGS. 11A through 11C are drawings showing changes in respective portions at a time when a user sits on the seat surface portion 301 and rests against the back surface portion 302.
Figure 11B:
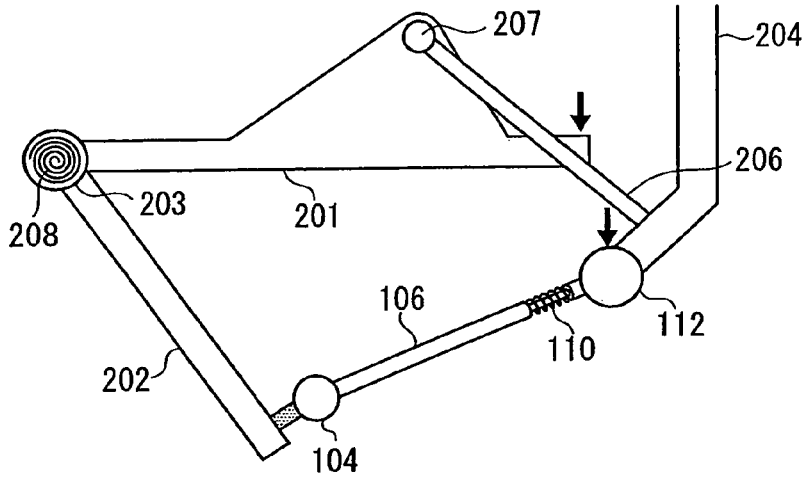
Figure 11C:
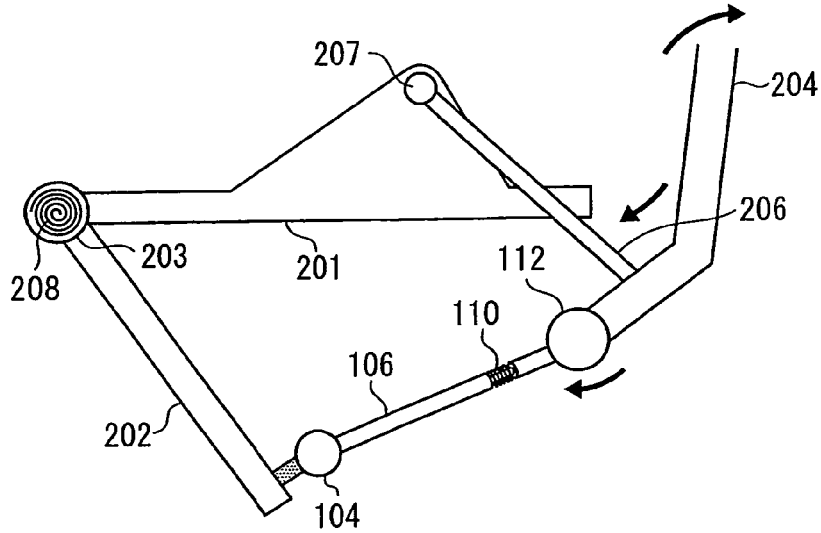

FIGS. 11A through 11C are drawings showing changes in respective portions at a time when the user sits on the seat surface portion 301 and rests against the back surface portion 302. Among the respective portions illustrated in FIG. 10, only the portions that are needed for explanation are selectively illustrated.

FIG. 11A shows a state before the user sits on the seat surface portion 301. The state shown in FIG. 11A is similar to the state of the respective portions shown in FIG. 10.

FIG. 11B shows a state in which the user has sat down on the seat surface portion 301, but before he/she rests against the back surface portion 302. Hereinafter, the processes from FIG. 11A to FIG. 11B will be described.

(1) When the user sits on the seat surface portion 301, the sixth link 201 rotates with the fifth joint portion 203 as the fulcrum, so as to sink-in.

(2) Accompanying the sinking-in of the sixth link 201, the eighth link 204 and the sixth joint portion 112 as well are pushed by the ninth link 206 and move downward.

(3) Accompanying the downward movement of the sixth joint portion 112, the third link 106 rotates clockwise as seen from the front surface of FIG. 11B, with the second joint portion 104 as the fulcrum. Further, accompanying this, the second joint portion 104 also rotates clockwise.

(4) Moreover, accompanying the sinking-in of the sixth link 201, the angle between the sixth link 201 and the seventh link 202 decreases, and elastic force in a direction of resisting this is generated by the third elastic resistance unit 208.

(5) At the point in time when the body weight of the user and these elastic forces are in equilibrium, rotation of the sixth link 201 stops, and the sinking-in of the seat surface portion 301 stops.

(6) At this point in time, the sit-in posture of the user is determined. As compared with the state before the user sits, the angle between the sixth link 201 and the eighth link 204 is narrow, and, for the user, there is the effect of the back surface portion 302 automatically approaching his/her back and fitting thereto. Namely, in the same way as in exemplary embodiments 1 through 4, the effect is obtained that the user obtains an optimal seated posture merely by sitting on the seat surface portion 301.

The operations of the respective portions at the time when the user sits on the seat surface portion 301 have been described above.

FIG. 11C shows the state at the time when the user rests against the rear surface portion 302 after having sat on the seat surface portion 301. Hereinafter, the processes from FIG. 11B to FIG. 11C will be described.

(7) When the user rests against the rear surface portion 302, the eighth link 204 tilts toward the back surface with the sixth joint portion 112 as the fulcrum.

(8) Simultaneously, the eighth link 204 rotates clockwise as seen from the front surface of FIG. 11C, with the seventh joint portion 207 being the center of rotation and with the ninth link 206 being the radius.

(9) When the eighth link 204 rotates clockwise, the sixth joint portion 112 is pushed substantially leftward (in the direction of the front surface of the user) as seen from the front surface of FIG. 11C.

(10) Accompanying this, the second elastic resistance unit 110 is pushed, and repelling elastic force that is directed clockwise in FIG. 11C (in the direction of the back surface of the user) is generated.

(11) At the point in time when the force at which the user rests against the back surface portion 302 and this repelling elastic force are in equilibrium, the tilting of the eighth link 204 stops, and the back-resting posture of the user is determined.

The operations of the respective portions at the time when the user sits on the seat surface portion 301 of the chair 400 have been described above.

Next, the exhibiting of similar effects by the chairs 400 relating to exemplary embodiments 1 through 4 and the chair 400 relating to present exemplary embodiment 5, will be described by using FIGS. 12A and 12B.

Figure 12A:
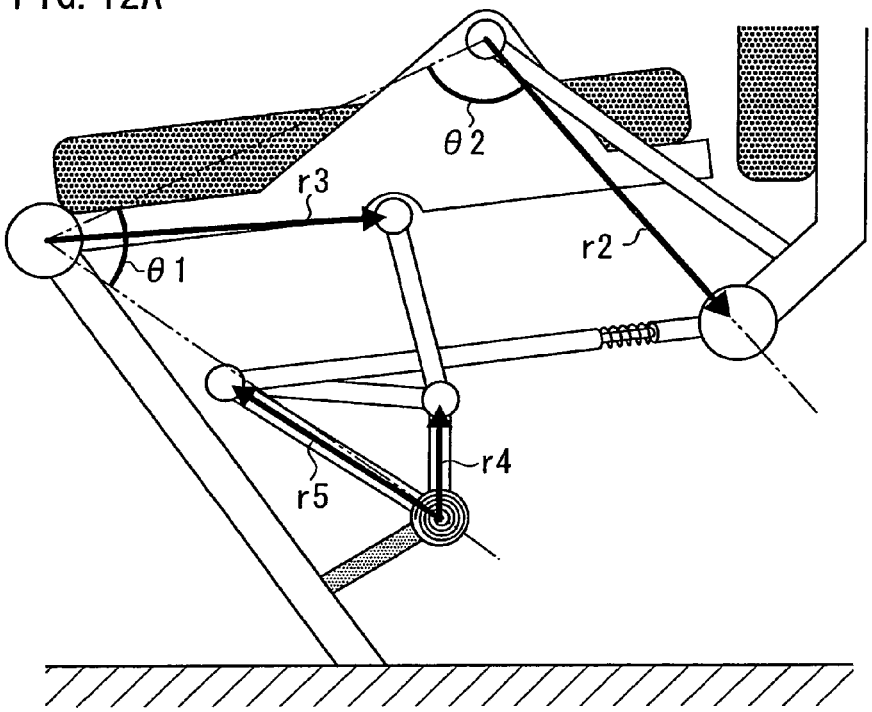
FIGS. 12A and 12B are drawings for explaining differences between, on the one hand, the chairs 400 relating to exemplary embodiments 1 through 4, and, on the other hand, the chair 400 relating to exemplary embodiment 5.
Figure 12B:
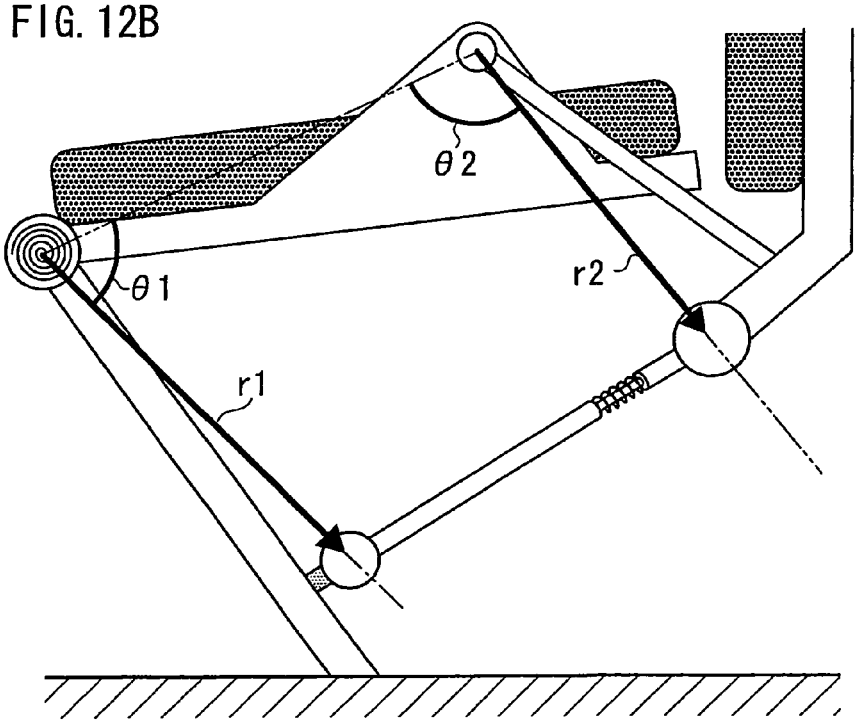

FIGS. 12A and 12B are drawings for explaining differences between, on the one hand, the chairs 400 relating to exemplary embodiments 1 through 4, and, on the other hand, the chair 400 relating to present exemplary embodiment 5. Here, FIG. 1 of exemplary embodiment 1 is exemplified in FIG. 12A, but the same holds for exemplary embodiments 2 through 4. Further, for convenience of drawing, the reference numerals of the respective portions are omitted.

For comparison, the structure shown in FIG. 1 of exemplary embodiment 1 is shown in FIG. 12A, and the structure shown in FIG. 10 of present exemplary embodiment 5 is shown in FIG. 12B.

In a case in which r2 shown in FIGS. 12A and 12B are equal, r1 in FIG. 12B is determined in accordance with following (formula 1).

$$r1=(r3/r4)r5 \quad \text{(formula 1)}$$

If r1 is determined per above (formula 1), the displacement of θ2 with respect to the displacement of (1 are substantially equal in FIG. 12A and FIG. 12B. Due thereto, in the same way as in exemplary embodiment 1, the effect of the back surface portion 302 automatically fitting to the back of the user can be obtained merely by the user sitting on the seat surface portion 301.

Figure 16:
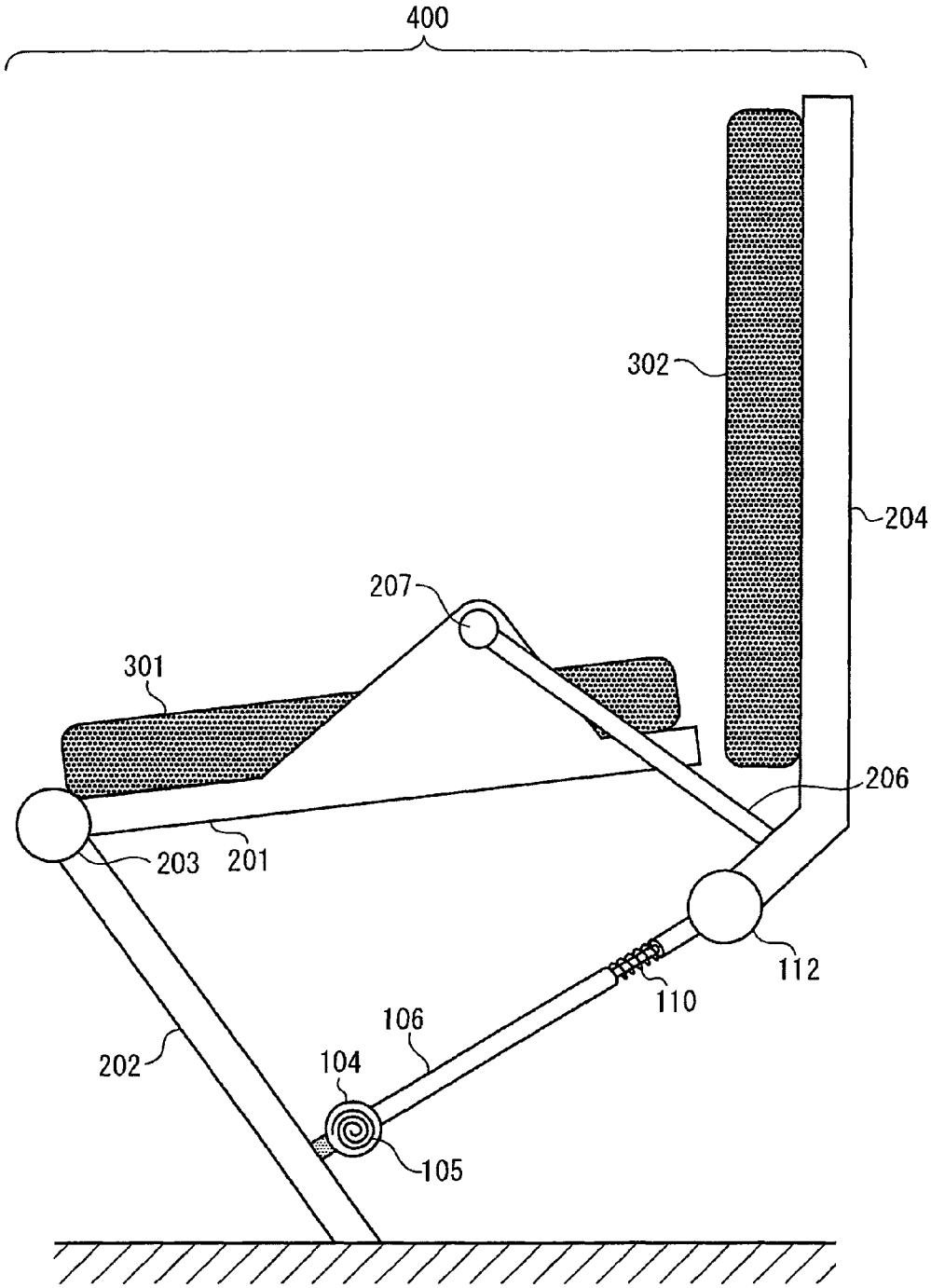
FIG. 16 is a schematic side view showing the structure of the chair 400 relating to a variation of the exemplary embodiment 5.

Present exemplary embodiment 5 describes an example in which the second joint portion 104 does not have the first elastic resistance unit 105, and instead, the third elastic resistance unit 208 is provided at the fifth joint portion 203. However, effects that are similar to those of present exemplary embodiment 5 are exhibited even when employing a structure in which the second joint portion 104 has the first elastic resistance unit 105 in the same way as in exemplary embodiments 1 through 4 (as shown in FIG. 16).

Further, the first elastic resistance unit 105 and the third elastic resistance unit 208 may both be used together.

The same holds for exemplary embodiments 6 and 7 that will be described hereinafter.

Figure 15:
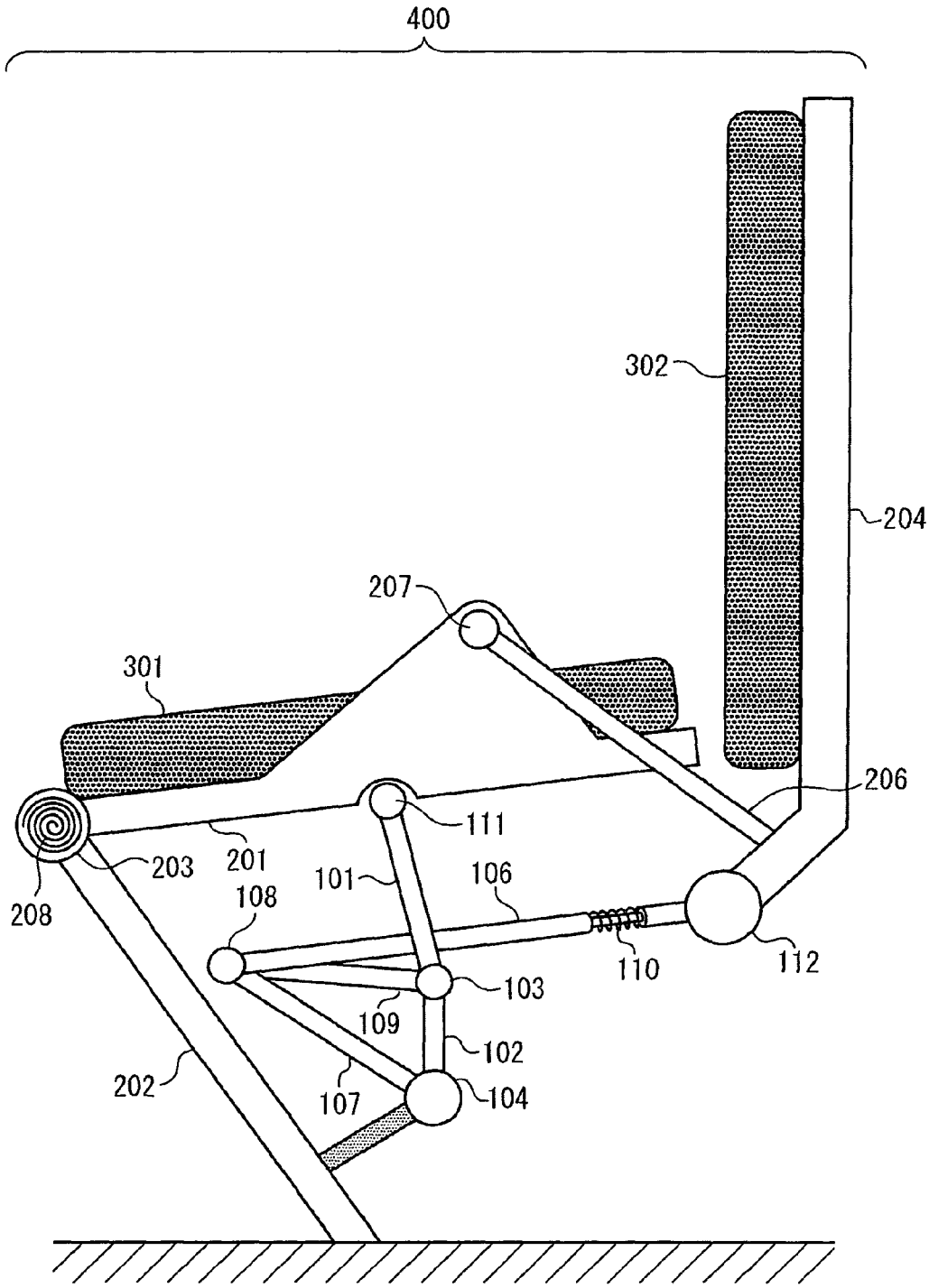
FIG. 15 is a schematic side view showing the structure of the chair 400 relating to a variation of the exemplary embodiment 1.

Further, in exemplary embodiments 1 through 4, instead of providing the first elastic resistance unit 105 at the second joint portion 104, the third elastic resistance unit 208 may be provided at the fifth joint portion 203 in the same way as in present exemplary embodiment 5 (for example, as shown in FIG. 15). Moreover, the first viscous resistance unit 113 that imparts viscous resistance may be provided at the fifth joint portion 203.

In addition, the first elastic resistance unit 105 and the third elastic resistance unit 208 may both be used together.

Effects that are similar to exemplary embodiments 1 through 4 can be exhibited also in cases in which these structures are employed.

As described above, in present exemplary embodiment 5, the structure of the link mechanism that imparts elastic force to the chair 400 is simplified, and parts costs and the like can be reduced.

However, the distance r1 that is explained in FIGS. 12A and 12B must be able to be made sufficiently large. Therefore, which of the structures of exemplary embodiments 1 through 4 and the structure of exemplary embodiment 5 to employ should be determined appropriately by taking into consideration whether or not there are restrictions thereon, and the like.

Exemplary Embodiment 6

Figure 13:
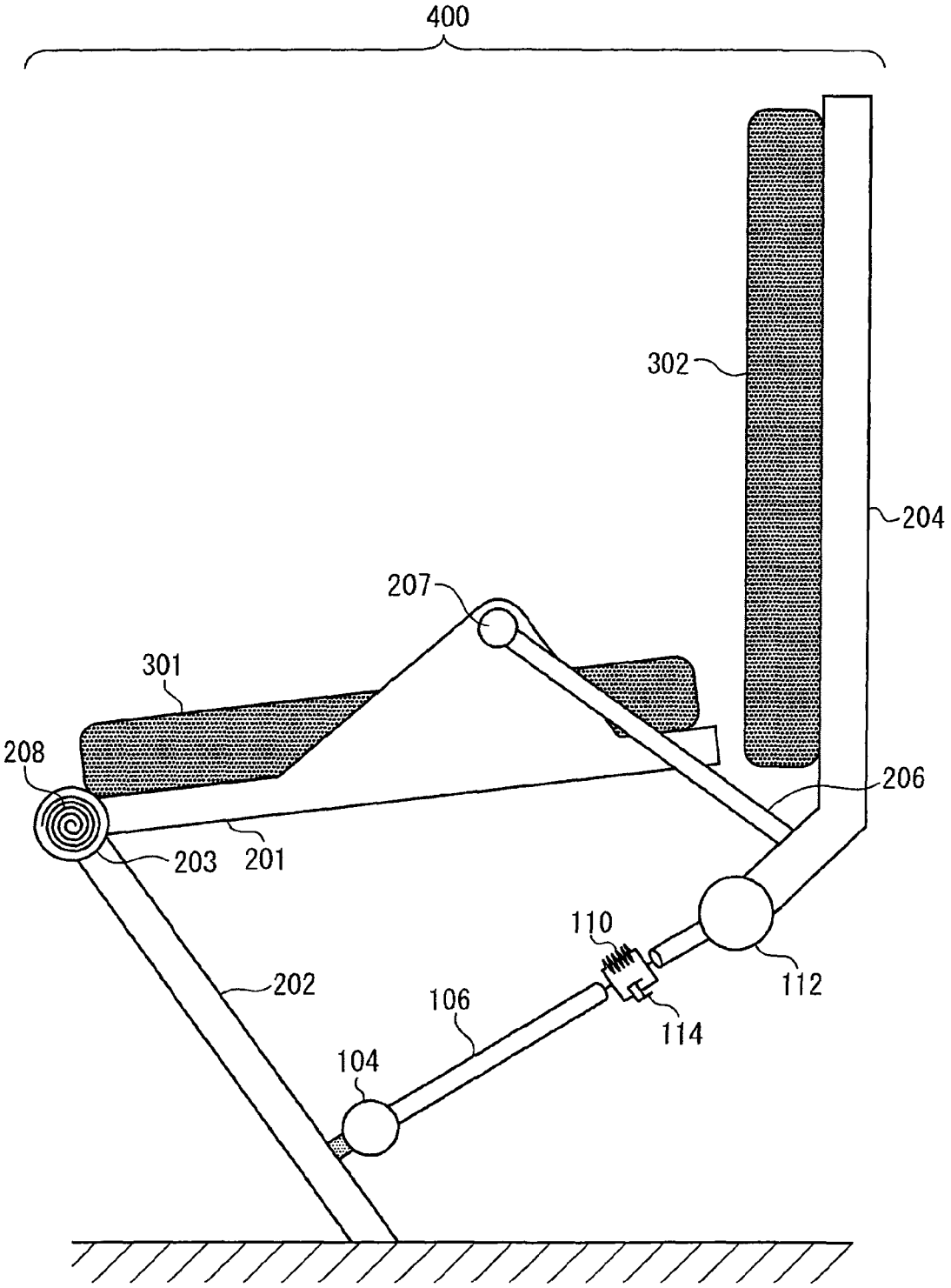
FIG. 13 is a schematic side view showing the structure of the chair 400 relating to exemplary embodiment 6.
Figure 14:
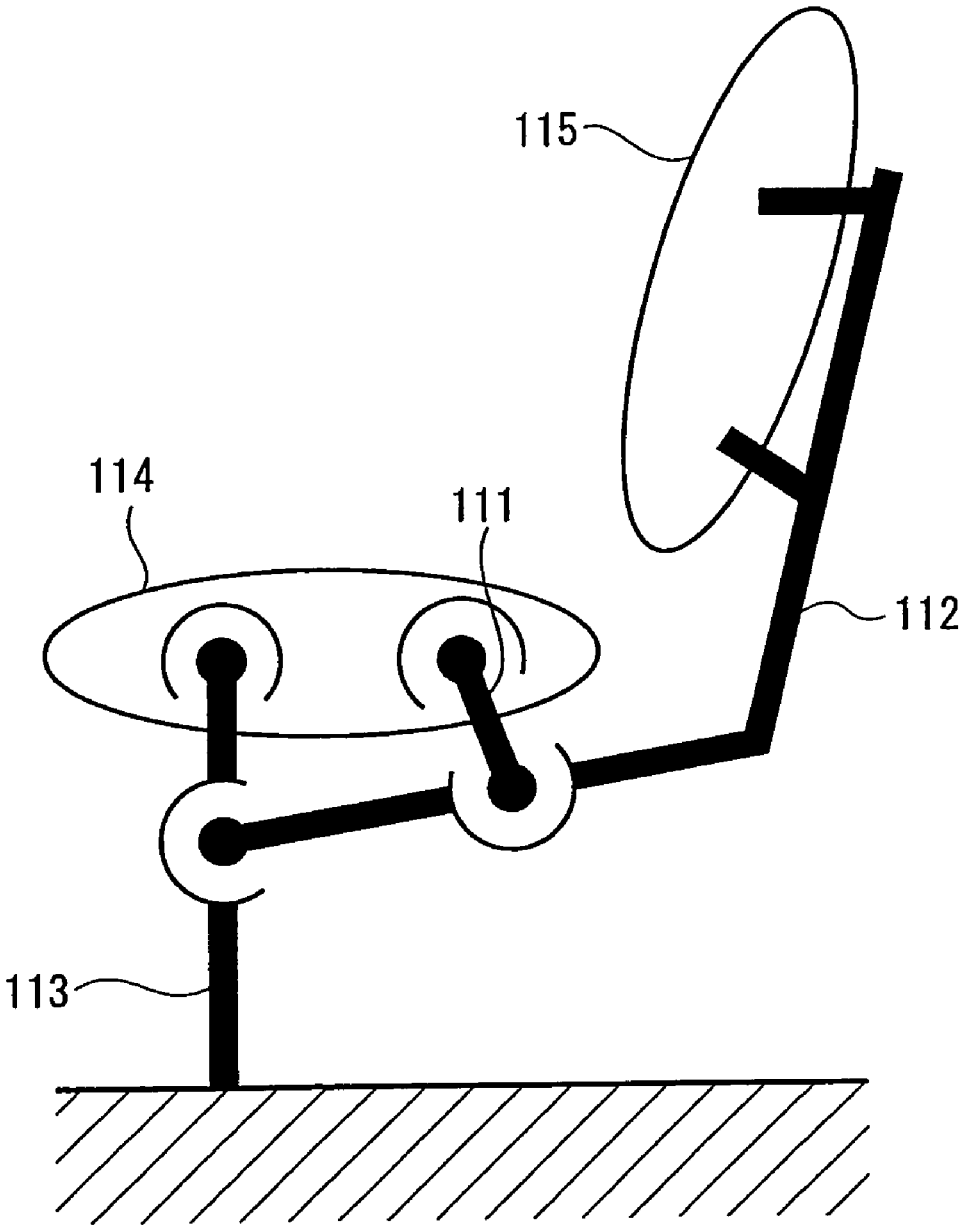
FIG. 14 RELATED ART
FIG. 14 is a drawing showing the structure of a conventional chair.

FIG. 13 is a schematic side view showing the structure of the chair 400 relating to exemplary embodiment 6 of the present invention.

The chair 400 relating to present exemplary embodiment 6 has, in addition to the structures described in exemplary embodiment 5, the second viscous resistance unit 114 that was described in exemplary embodiment 2. The other structures thereof are similar to those of exemplary embodiment 5.

In accordance with the chair 400 relating to present exemplary embodiment 6, in addition to the effects described in exemplary embodiment 5, the effects described in exemplary embodiment 2 can be exhibited.

Exemplary Embodiment 7

In above-described exemplary embodiments 1 through 6, a fourth elastic resistance unit that imparts elastic force in the rotating direction may be provided at the seventh joint portion 207. Due thereto, in addition to the second elastic resistance unit 110, the resistance force at the time when the user rests against the rear surface portion 302 can be adjusted.

Further, a third viscous resistance unit (a third damper), that, when rotational force is applied to the third elastic resistance unit 208, absorbs the rotational force, may be provided.

Moreover, a fourth viscous resistance unit (a fourth damper), that, when rotational force is applied to the fourth elastic resistance unit, absorbs the rotational force, may be provided.

In addition, in exemplary embodiment 5, in a case of employing the structure in which the second joint portion 104 is provided with the first elastic resistance unit 105, the first viscous resistance unit 113 that imparts viscous resistance may be provided at the second joint portion 104.

Note that the drawings used in above-described exemplary embodiments 1 through 7 are schematic drawings for illustrating the structures, and do not accurately illustrate the sizes of the respective portions and the like of the actual chairs 400.

In accordance with a first aspect of the present invention, there is provided a link mechanism for a chair that is a link mechanism that is used at a chair, the link mechanism for a chair having: a first link whose one end is connected to a bottom surface of a link that supports a seat surface portion of the chair; a second link whose one end is connected to another end of the first link; a first joint portion rotatably connecting the first link and the second link; a second joint portion provided at another end of the second link; and a first elastic resistance unit imparting elasticity in a rotating direction to the second joint portion.

In accordance with the link mechanism for a chair relating to the present invention, when a user sits down, the first link is pushed by the seat surface portion, and the elastic force of the first elastic resistance unit is applied. Due thereto, the user can assume an optimal seated posture without pushing the backrest.

Exemplary embodiments of the present invention are described above, but the present invention is not limited to the exemplary embodiments as will be clear to those skilled in the art.

What is claimed is:

1. A chair comprising:
- a seat surface portion;
- a back surface portion;
- a first link supporting the seat surface portion;
- a second link supporting the back surface portion;
- a third link having one end connected to the second link;
- a fourth link connected to another end of the third link;
- a first joint portion rotatably connecting the third link and the fourth link;
- a second joint portion rotatably connecting the first link and the fourth link;
- a third joint portion rotatably connecting the third link and the second link;
- a first elastic resistance unit imparting repulsion elasticity to the third link;
- a second elastic resistance unit imparting elasticity in a rotating direction to the second joint portion; and
- a fourth joint portion rotatably connecting the first link and the second link.

2. The chair of claim 1, further comprising:
- a fifth link having one end connected to the first link, and having another end connected to the second link;
- wherein the fourth joint portion rotatably connects the first link and the fifth link, and
- wherein the first link and the fifth link are structured such that the fourth joint portion is disposed at a position that is apart and forward from the second link by a predetermined distance.

3. The chair of claim 1, further comprising, in addition to the second elastic resistance unit, a third elastic resistance unit that imparts elasticity in a rotating direction to the first joint portion.

4. The chair of claim 3, further comprising a first viscous resistance unit imparting viscous resistance to the first joint portion.

5. The chair of claim 1, further comprising a second viscous resistance unit imparting viscous resistance to the third link.

6. The chair of claim 1, further comprising a third viscous resistance unit imparting viscous resistance to the second joint portion.

7. A chair, comprising:
- a seat surface portion;
- a back surface portion;
- a first link supporting the seat surface portion;
- a second link supporting the back surface portion;
- a third link having one end connected to the second link;
- a fourth link connected to another end of the third link;
- a first joint portion rotatably connecting the third link and the fourth link;
- a second joint portion rotatably connecting the first link and the fourth link;
- a third joint portion rotatably connecting the third link and the second link;
- a first elastic resistance unit imparting repulsion elasticity to the third link;
- a second elastic resistance unit imparting elasticity in a rotating direction to the first joint portion; and
- a fourth joint portion rotatably connecting the first link and the second link.

8. The chair of claim 7, further comprising:
- a fifth link having one end connected to the first link, and having another end connected to the second link;
- wherein the fourth joint portion rotatably connects the first link and the fifth link, and
- wherein the first link and the fifth link are structured such that the fourth joint portion is disposed at a position that is apart and forward from the second link by a predetermined distance.

9. The chair of claim 7, further comprising, in addition to the second elastic resistance unit, a third elastic resistance unit that imparts elasticity in a rotating direction to the second joint portion.

10. The chair of claim 9, further comprising a first viscous resistance unit imparting viscous resistance to the second joint portion.

11. The chair of claim 7, further comprising a second viscous resistance unit imparting viscous resistance to the third link.

12. The chair of claim 7, further comprising a third viscous resistance unit imparting viscous resistance to the first joint portion.

* * * * *